US008706015B2

(12) United States Patent
Nakayama et al.

(10) Patent No.: US 8,706,015 B2
(45) Date of Patent: Apr. 22, 2014

(54) FIXING DEVICE INCLUDING FIXING BELT AND IMAGE FORMING APPARATUS USING THE SAME

(75) Inventors: Atsuyoshi Nakayama, Osaka (JP); Akihiko Taniguchi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 261 days.

(21) Appl. No.: 13/271,323

(22) Filed: Oct. 12, 2011

(65) Prior Publication Data

US 2012/0121302 A1 May 17, 2012

(30) Foreign Application Priority Data

Nov. 17, 2010 (JP) ..... 2010-256740

(51) Int. Cl.
*G03G 15/20* (2006.01)

(52) U.S. Cl.
USPC ..... 399/329

(58) Field of Classification Search
USPC ..... 399/329, 328; 219/469–471, 216
See application file for complete search history.

(56) References Cited

U.S. PATENT DOCUMENTS

| | | | | |
|---|---|---|---|---|
| 4,114,021 | A * | 9/1978 | Nishide et al. | 219/216 |
| 6,826,382 | B2 | 11/2004 | Sanpei et al. | |
| 8,010,029 | B2 * | 8/2011 | Kim et al. | 399/329 |
| 8,107,857 | B2 * | 1/2012 | Kobayashi | 399/329 |
| 8,116,670 | B2 * | 2/2012 | Shinshi | 399/329 |
| 8,509,667 | B2 * | 8/2013 | Miyauchi | 399/329 |
| 2003/0063931 | A1 | 4/2003 | Sanpei et al. | |
| 2007/0280757 | A1 | 12/2007 | Kimura | |
| 2008/0112737 | A1 * | 5/2008 | Kang et al. | 399/328 |
| 2008/0219724 | A1 * | 9/2008 | Lee et al. | 399/329 |
| 2008/0232871 | A1 * | 9/2008 | Jung et al. | 399/329 |
| 2009/0010688 | A1 * | 1/2009 | Takahashi et al. | 399/328 |
| 2009/0110451 | A1 * | 4/2009 | Jung et al. | 399/329 |
| 2009/0180821 | A1 | 7/2009 | Kagawa | |
| 2010/0098468 | A1 * | 4/2010 | Lee | 399/329 |
| 2011/0217094 | A1 * | 9/2011 | Hasegawa | 399/329 |
| 2011/0274453 | A1 * | 11/2011 | Shimokawa et al. | 399/329 |
| 2012/0057909 | A1 * | 3/2012 | Gon | 399/329 |

FOREIGN PATENT DOCUMENTS

| | | |
|---|---|---|
| JP | 05-107961 A | 4/1993 |
| JP | 2003-107946 A | 4/2003 |
| JP | 2007-322888 | 12/2007 |
| JP | 2009-169030 | 7/2009 |

* cited by examiner

*Primary Examiner* — Susan Lee
(74) *Attorney, Agent, or Firm* — Renner, Otto, Boisselle & Sklar, LLP

(57) ABSTRACT

An image forming apparatus includes photoreceptor drums, a charger, an exposure unit, a developing unit, an intermediate transfer belt and a fixing unit for fixing a toner image to a recording medium. The fixing unit includes a fixing part and a pressing part. The fixing part has a fixing roller, a heating member and a fixing belt. The pressing part has a pressing roller. The heating member is arranged close to, and so as to cover, the outer peripheral side of the fixing roller, and formed with an opening. Both edges of the opening extending along the axial direction of the fixing roller, are positioned closer to the pressing part side than the center axis of the fixing roller is.

7 Claims, 7 Drawing Sheets

FIXING DEVICE INCLUDING FIXING BELT AND IMAGE FORMING APPARATUS USING THE SAME

This Nonprovisional application claims priority under 35 U.S.C. §119 (a) on Patent Application No. 2010-256740 filed in Japan on 17 Nov. 2010, the entire contents of which are hereby incorporated by reference.

BACKGROUND OF THE INVENTION (1) Field of the Invention

The present invention relates to a fixing device and an image forming apparatus using the device, in particular relating to a fixing device using a fixing belt, for use in an image forming apparatus for forming images using toner based on electrophotography, such as an electrostatic copier, laser printer, facsimile machine or the like, as well as to an image forming apparatus using this device.

(2) Description of the Prior Art

Conventionally, an image forming apparatus based on electrophotography (for example, a printer) includes a fixing device which fuses a toner image formed on a recording sheet (recording paper or sheet) to fix the image onto the sheet. As an example of the fixing device, a paired roller type fixing device that is composed of a fixing roller and a pressing roller has been known.

The fixing roller is a roller component which is formed of a hollow metal core made of aluminum or the like and an elastic layer formed thereon and has halogen lamps as a heat source arranged inside the core.

In this arrangement, a temperature controller is also provided so as to control the surface temperature of the fixing roller by performing on/off control of the halogen lamps based on the signal output from a temperature sensor disposed on the fixing roller surface.

The pressing roller is a roller component composed of a metal core on which a heat-resistant elastic layer of silicone rubber or the like is formed as a coating layer. This pressing roller is put in pressure contact with the peripheral side of the fixing roller, forming a nip area between the fixing roller and the pressing roller due to the elastic deformation of the elastic layer of the pressing roller.

In the above arrangement of the fixing device, the paper with an unfixed toner image formed thereon is delivered into and between the fixing roller and the pressing roller or a nip area, and conveyed by these rollers as they rotate so that the toner image on the paper is heated by the peripheral side of the fixing roller and fused and fixed to the paper.

However, since the fixing and pressing rollers of the conventional paired roller type remain at room temperature when the image forming apparatus is turned on at the time of the first activation in the morning, the surface temperature of the rollers needs to be raised to a predetermined temperature after power activation, which requires warm-up time. Since it is also necessary to keep the roller surface at the predetermined temperature when the apparatus is in its standby mode in which no copying operation is performed, the fixing device needs to be heated constantly even when no copying operation is performed. In this way, the conventional configurations have the problem that waste energy is consumed by other than an image forming operation.

In order to solve the above problem, there is a proposal of a fixing device which does not use the fixing roller but uses a fixing belt having a lower heat capacity, instead (see Patent Document 1).

This fixing device includes a fixing roller and a curved plate-shaped heater and is constructed to heat and press the unfixed image formed on the recording medium by means of an endless fixing belt wound on the fixing roller and the outer peripheral side of the curved plate-shaped heater and a pressing roller.

PRIOR ART DOCUMENT

Patent Document 1

Japanese Patent Application Laid-open 2009-169030

However, since heat radiation from the surface of the fixing belt in the other area than where the curved plate-shaped heater exists is not negligible, the fixing device of Patent Document 1 has the problem of loss of heat energy, causing fixing failure.

SUMMARY OF THE INVENTION

The present invention has been devised in view of the above conventional problem, it is therefore an object of the present invention to provide a fixing device that can reduce loss of heat energy therein and can achieve stable fixing of toner images to recording mediums as well as proving an image forming apparatus using this device.

The fixing device and image forming apparatus using this according to the present invention to solve the above problem are as follows:—

The first aspect of the present invention resides in a fixing device comprising a fixing part and a pressing part, the fixing part including:

a fixing roller;

a heating member as a heat generator having a curved surface; and, an endless fixing belt wound between the fixing roller and the outer peripheral side of the heating member, the pressing part being arranged so as to oppose the fixing roller and press the fixing roller via the fixing belt, characterized in that the heating member is arranged close to, and so as to cover, the outer peripheral side of the fixing roller, and formed with an opening extending along the axial direction of the fixing roller so as to open, at least, the portion where the fixing roller and the pressing part oppose each other, and the edges defining the opening, extending along the axial direction of the fixing roller, are positioned closer to the pressing part side than the center axis of the fixing roller is.

The second aspect of the present invention resides in that the heating member has a circular arc cross-section curved concentrically with the fixing roller.

The third aspect of the present invention resides in that the heating member generates uneven distribution of heat with respect to the circumferential direction of the fixing roller.

The fourth aspect of the present invention resides in that the distribution of heat generated by the heating member is specified such that the heating value per unit area is higher at a place as the contact force (tension) with the fixing belt is stronger at the place.

The fifth aspect of the present invention resides in that an insulating member that covers the heating member in whole or in part via the fixing belt is arranged close to the outer peripheral part of the fixing belt that is put in contact with the heating member.

The sixth aspect of the present invention resides in that the insulating member has a circular arc cross-section curved concentrically with the fixing roller.

The seventh aspect of the present invention resides in an image forming apparatus including a fixing device for fixing a toner image formed on a recording medium to the recording medium, characterized in that the fixing device employs the fixing device defined in any one of the above first to sixth aspects.

According to the first aspect of the present invention, the fixing belt can take a large enough area to receive heat from the heating member and at the same time, can cover the heating member in its portion located closer to the pressing part side than the central axis of the fixing roller is. Accordingly, this configuration not only prevents heat leakage but also enables use of heat from the backside of the heating member. As a result, it is possible to reduce loss of heat energy in the fixing device and achieve stable fixing of toner images to recording mediums.

According to the second aspect of the present invention, it is possible to cover the fixing roller by taking up the minimum cross section so as to achieve the maximum use of heat from the backside of the heating member.

According to the third aspect of the present invention, for example, since a main heat generator and sub heat generators having different heating values are arranged in the curved plate-shaped heat generator with respect to the circumferential direction of the fixing roller, it is possible to efficiently convert input power into heat energy.

According to the fourth aspect of the present invention, by increasing the heating value at the area where the fixing belt and the fixing member come into hermetic contact with each other, it is possible to efficiently conduct heat from the heating member to the fixing belt.

According to the fifth aspect of the present invention, it is possible to inhibit radiation of heat from the surface of the fixing belt.

According to the sixth aspect of the present invention, the surface of the fixing belt is covered by taking up the minimum cross section, so that is possible to minimize diffusion of heat from the fixing belt.

According to the seventh aspect of the present invention, it is possible to alleviate loss of heat energy in the fixing device, hence provide an image forming apparatus that can shorten its warm-up time and is excellent in energy saving performance.

DESCRIPTION OF THE PREFERRED EMBODIMENTS

Now, the embodied modes for carrying out the present invention will be described with reference to the drawings.

Figure 1:
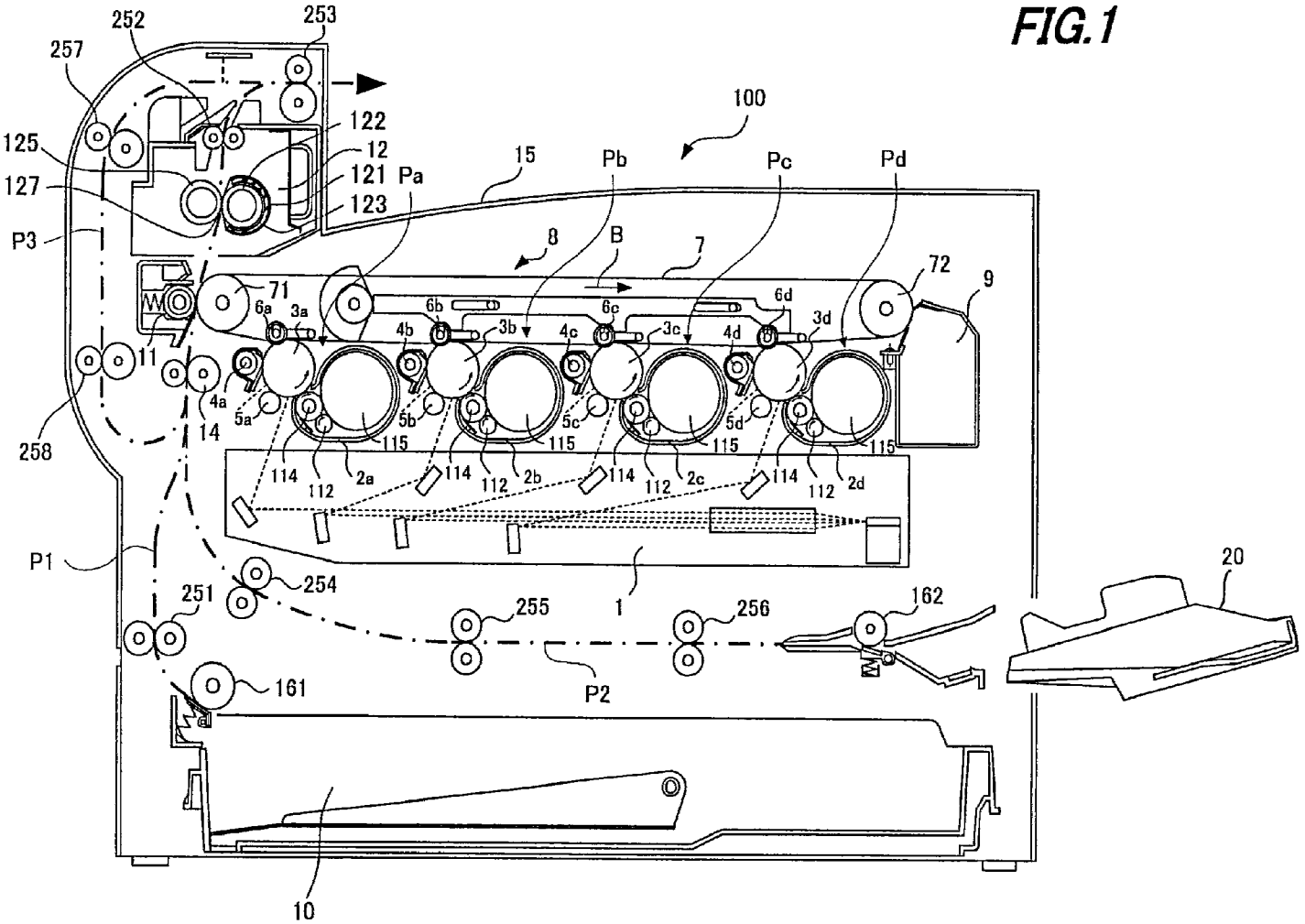
FIG. 1 is an illustrative view showing the overall configuration of an image forming apparatus according to the embodiment of the present invention.

FIG. 1 shows one example of a mode for carrying out the invention and is an illustrative view showing the overall configuration of an image forming apparatus according to the embodiment of the present invention.

An image forming apparatus 100 of the present embodiment forms images with toner based on electrophotography, including: as shown in FIG. 1, photoreceptor drums 3*a*, 3*b*, 3*c* and 3*d* (which may be also called "photoreceptor drums 3" when general mention is made) for forming electrostatic latent images on the surfaces thereof; chargers (charging devices) 5*a*, 5*b*, 5*c* and 5*d* (which may be also called "chargers 5" when general mention is made) for charging the surfaces of photoreceptor drums 3; an exposure unit (exposure device) 1 for forming electrostatic latent images on the photoreceptor drum 3 surfaces; developing devices 2*a*, 2*b*, 2*c* and 2*d* (which may be also called "developing devices 2" when general mention is made) for supplying toners to the electrostatic latent images on the photoreceptor drum 3 surfaces to form toner images; an intermediate transfer belt unit (transfer device) 8 for transferring a toner image from the photoreceptor drum 3 surface to a recording medium; and a fixing unit (fixing device) 12 for fixing the toner image to the recording medium. This image forming apparatus 100 reduces loss of heat energy in fixing unit 12 to attain stable fixing of the toner image to the recording medium.

This image forming apparatus 100 is an apparatus that forms multi-color or monochrome images on recording mediums in accordance with image data scanned from documents or image data transmitted via a network or the like.

To being with, the overall configuration of image forming apparatus 100 will be described.

As shown in FIG. 1, image forming apparatus 100 separately handles image data of individual color components, i.e., black (K), cyan (C), magenta (M) and yellow (Y), and forms black, cyan, magenta and yellow images, superimpose these images of different color components to produce a full-color image.

Accordingly, image forming apparatus 100 includes, as shown in FIG. 1, four developing devices 2 (2*a*, 2*b*, 2*c* and 2*d*), four photoreceptor drums 3 (3*a*, 3*b*, 3*c* and 3*d*), four chargers 5 (5*a*, 5*b*, 5*c* and 5*d*) and four cleaner units 4*a*, 4*b*, 4*c* and 4*d* (which may also be called "cleaner units 4" when general mention is made) to form images of four different colors. In other words, four image forming stations (image forming portions) each including one developing device 2, one photoreceptor drum 3, one charger 5 and one cleaner unit 4 are provided.

Here, the symbols a to d are used so that 'a' represents the components for forming black images, 'b' the components for forming cyan images, 'c' the components for forming magenta images and 'd' the components for forming yellow images. Image forming apparatus 100 also includes exposure unit 1, fixing unit 12, a sheet conveyor passage (paper conveying paths) P1, P2 and P3 and a paper feed tray 10 and a paper output tray 15.

Photoreceptor drum 3 is a roller-like member that is rotatably supported and driven on an axis thereof by means of an unillustrated driver. Photoreceptor drum 3 is an image bearer which includes a photosensitive layer and bears an electrostatic latent image and hence a toner image on the surface of the photosensitive layer.

For example, photoreceptor drum 3 can be formed of a conductive substrate made of aluminum or the like and a photosensitive layer formed on the conductive substrate surface.

The conductive substrate may preferably use a sleeve-like, cylindrical or sheet-like conductive base.

As the photosensitive layer, an organic photosensitive layer, inorganic photosensitive layer and the like can be considered.

The organic photosensitive layer may be given as a lamination type in which a charge generating layer made of a resin containing a charge generating substance and a charge transport layer made of a resin containing a charge transport substance are laminated, may be given as a mono-layer type including both a charge generating substance and a charge transport substance in a single resin layer, or may be given as a resin lamination layer including one or more kinds of the resin layers in combination.

It is also preferable that a primer layer is interposed between the conductive base and the photosensitive layer.

It is also preferable that a surface layer (protective layer) is formed on the photosensitive layer surface in order to protect the photosensitive layer.

Charger 5 is a member that electrifies the photoreceptor drum 3 surface at a predetermined potential of a predetermined polarity.

This charger 5 is disposed along the longitudinal direction of photoreceptor drum 3 so as to oppose photoreceptor drum 3. When the charger is of a contact charging type, charger 5 is arranged in contact with the photoreceptor drum 3 surface. When the charger is a non-contact charging type, charger 5 is arranged apart from the photoreceptor drum 3 surface.

As charger 5, a brush-type charger, roller-type charger, corona discharge device, ion generator and the like can be used.

The brush-type charger and roller-type charger are of contact charging types. The brush-type charger includes a type using a changing brush, a magnetic brush and the like.

The corona discharge device and ion generator are of non-contact charging types. The corona discharge devices include various types, specifically, a type using a wire-like discharge electrode, a type using a saw-toothed type discharge electrode, a type using a needle-shaped electrode and the like.

Exposure unit 1 illuminates by laser beam the surface of photoreceptor drums 3 that have been electrified, in accordance with image data of digital signals so as to form electrostatic latent images corresponding to the image data, on the surfaces of photoreceptor drums 3. Exposure unit 1 may use a semiconductor laser device or the like. Other than the laser scanning unit, arrays of light emitting elements such as EL (electroluminescence) and LED writing heads, may also be used as exposure unit 1.

Developing device 2 includes a developing roller 114 and agitating roller 112.

Developing roller 114 is a roller-shaped member that is rotatably supported on its axis. Developing roller 114 is arranged with its part projected outwards from an opening of the developing device formed on the side opposing photoreceptor drum 3 so as to be placed close to the photoreceptor drum 3 surface.

Developing roller 114 incorporates unillustrated fixed magnetic poles, which support the developer on the surface of developing roller 114 by magnetism. Developing roller 114 supplies the carried developer to the electrostatic latent image on the surface of photoreceptor drum 3 in the close area (developing nip) between developing roller 114 and photoreceptor drum 3 to thereby form a toner image on the photoreceptor drum 3 surface. Developing roller 114 rotationally driven in the opposite direction to that of photoreceptor drum 3. Accordingly, in the developing nip area, the surface of developing device 114 and the surface of photoreceptor drum 3 move in the same direction.

Developing roller 114 is connected to an unillustrated power source and applied with a d.c. voltage (developing voltage) from the power source. By this application, the developer on the developer roller 114 surface is smoothly supplied to the electrostatic latent image. The applied voltage may be superimposed with an a.c. voltage.

Developing device 2 is a receptacle member having an interior space, and its one side opposing photoreceptor drum 3 is formed with the aforementioned opening. Developing device 2 includes agitating roller 112 in the interior space and stores the developer. As the developer, a usually used developer in this field can be used. Further, the developer may be a single component developer consisting of toner only, or may be a dual component developer made up of a toner and a carrier.

Agitating roller 112 is a screw-shaped member that is rotatably supported on its axis in the interior space of developing device 2. Agitating roller 112 is rotationally driven to bring the developer in developing device 2 to or the vicinity of developing roller 114.

A developer supply container 115 is a receptacle member for storing the developer in its interior space. Developer supply container 115 supplies the developer to developing device 2 in accordance with the state of consumption of the developer in the developing device 2.

Cleaner unit 4 removes and collects the developer left on the surface of photoreceptor drum 3 after the toner image on the photoreceptor drum 3 surface has been transferred to the recording medium.

Photoreceptor charge eraser (not illustrated) erases the electricity on photoreceptor drum 3 after the leftover developer has been collected by the drum cleaner. The photoreceptor charge eraser may employ lamps, LEDs or other illumination.

Intermediate transfer belt 7 is laid out over photoreceptor drums 3 and is tensioned between a drive roller 71 and a driven roller 72, forming a loop-like moving path. Photoreceptor drum **3*d*, photoreceptor drum 3*c*, photoreceptor drum 3*b* and photoreceptor drum 3*a* are arranged in this order so as to oppose the outer peripheral surface of intermediate transfer belt 7. Primary transfer rollers 6*a* to 6*d* are disposed at positions on the opposite side to respective photoreceptor drums 3*a* to 3*d* with the intermediate transfer belt 7 therebetween. The position at which intermediate transfer belt 7 opposes each of photoreceptor drums 3*a* to 3*d* forms a primary transfer station. Intermediate transfer belt 7** is formed of a film of about 100 to 150 μm thick.

In order to transfer the toner images carried on the surface of photoreceptor drums **3*a* to 3*d* to intermediate transfer belt 7, a primary transfer bias of a polarity opposite to the polarity of the electrostatic charge on the toner is applied to primary transfer rollers 6*a* to 6*d* by constant voltage control. By this voltage application the toner images of individual colors formed on photoreceptor drums 3*a* to 3*d* are successively transferred one over the other on the outer peripheral surface of intermediate transfer belt 7 so as to form a full-color toner image on the outer peripheral surface of intermediate transfer belt 7**.

However, when image data for only part of four colors, yellow (Y), magenta (M), cyan (C) and black (K) is input, electrostatic latent images and hence toner images are formed on only the photoreceptor drums 3 that correspond to the colors of the input image data, among four photoreceptor drums **3*a* to 3*d*. For example, at the time of monochrome image forming, an electrostatic latent image and hence toner image is formed on only the photoreceptor drum 3*a* that corresponds to black color, and the black toner image alone is transferred to the outer peripheral surface of intermediate transfer belt 7**.

Each of primary transfer rollers 6*a* to 6*d* is formed of a base shaft made of metal such as stainless steel having a diameter of 8 to 10 mm and a conductive elastic material (e.g., EPDM (ethylene-propylene diene terpolymer), foamed urethane or the like) coated on the shaft surface. This conductive elastic material contributes to uniform application of a high-voltage to intermediate transfer belt 7.

The toner image transferred to the outer peripheral surface of intermediate transfer belt 7 at each primary transfer station is conveyed by rotation of intermediate transfer belt 7 to the secondary transfer station that opposes a secondary transfer roller 11. The secondary transfer roller 11 is put into press-contact with the peripheral surface of drive roller 71 via intermediate transfer belt 7 under a predetermined nipping pressure.

A high voltage of a polarity opposite to the polarity of the electrostatic charge on the toner is applied to secondary transfer roller 11 when the recording medium fed from a paper feed cassette 10 or a manual paper feed tray 20 passes through the nip between secondary transfer roller 11 and intermediate transfer belt 7. As a result, the toner image is transferred from the outer peripheral surface of intermediate transfer belt 7 to the recording medium surface.

Of the toner adhering from photoreceptor drums 3 to intermediate transfer belt 7, the toner that has not been transferred to the recording medium but remains on intermediate transfer belt 7 is collected by a transfer cleaning unit 9 in order to prevent contamination of colors in the next operation.

Figure 2:
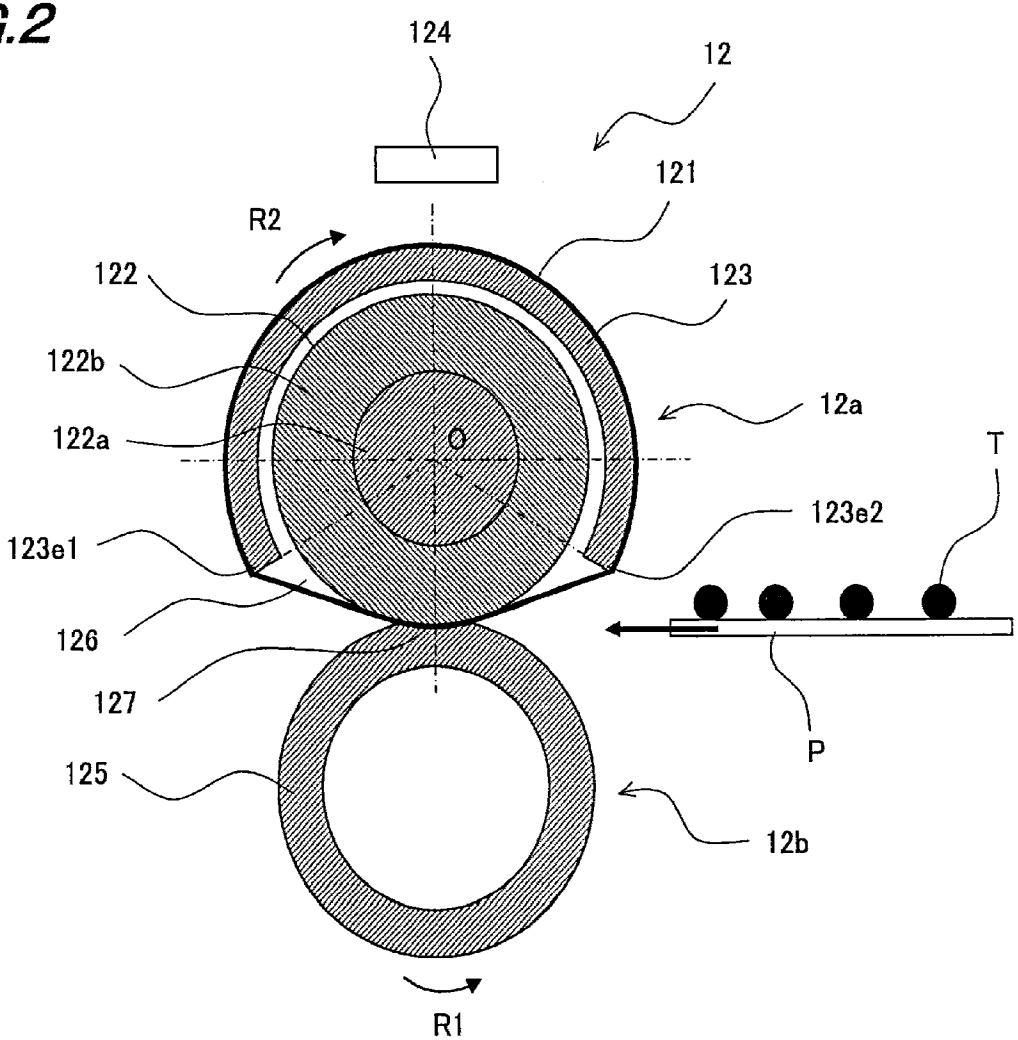
FIG. 2 is an illustrative view showing a characteristic configuration of a fixing unit according to the present embodiment.

The recording medium with the toner image transferred thereon is lead to fixing unit 12, and heated and pressed by being passed through a fixing nip portion 127 formed between a fixing belt 121 tensioned between fixing roller 122 and heating member 123 and pressing roller 125 (FIG. 2). As a result, the toner image is robustly fixed to the recording medium surface. The recording medium with the toner image fixed is discharged onto paper output tray 15 by means of a conveying roller 252 and paper output roller 253 (FIG. 1).

Arranged in image forming apparatus 100 is a paper conveying passage P1 that extends in an approximately vertical direction in order to convey a recording medium stored in paper feed cassette 10 through the nip between secondary transfer roller 11 and intermediate transfer belt 7 and fixing unit 12 to paper output tray 15.

Arranged along paper conveying passage P1 are a pickup roller 161 for delivering sheet-like recording mediums one sheet at a time from paper feed cassette 10 to paper conveying passage 21, conveying rollers 251 for conveying the delivered recording medium upwards, a registration roller 14 that leads the conveyed recording medium towards the nip between secondary transfer roller 11 and intermediate transfer belt 7 at a predetermined timing, and paper output roller 253 for discharging the recording medium to paper output tray 15.

Also, a paper conveying passage P2 along which a pickup roller 162, conveying rollers 254, 255 and 256 are laid out is formed from manual paper feed tray 20 to registration roller 14. Further, a paper conveying passage P3 is formed from paper output roller 253 to the upstream side of registration roller 14 in paper conveying passage P1.

Paper output roller 253 is adapted to rotate in both forward and reverse directions. The paper output roller is turned in the forward direction so as to discharge the recording medium to paper output tray 15, in one-sided image forming mode in which image forming is performed on one side of the recording medium and when image forming is performed on the second side of the recording medium in duplex image forming mode in which images are formed on both sides of the recording medium. On the other hand, at the time of image forming on the first side in the duplex image forming mode, paper output roller 253 is driven in the forward direction until the rear end of the recording medium passes through fixing unit 12 and then driven in reverse from the state in which the paper output rollers hold the rear end of the recording medium, so as to lead the recording medium into paper conveying passage P3. As a result, the recording medium with an image formed on one side in the duplex image forming mode is turned upside down with the front side inverted to the rear, and drawn to paper conveying passage P1 by means of conveying rollers 257 and 258.

Registration roller 14 delivers the recording medium, fed from paper feed cassette 10, or manual paper feed tray 20, or conveyed by way of paper conveying passage P3, to the nip between secondary transfer roller 11 and intermediate transfer belt 7 at a timing in synchronization with the rotation of intermediate transfer belt 7. For this purpose, registration roller 14 is suspended to rotate when photoreceptor drums 3 and intermediate transfer belt 7 start operating, and the recording medium that has been fed or conveyed ahead of the rotation of intermediate transfer belt 7, puts its front edge against registration roller 14 and stops moving in paper conveying passage P1. Then, registration roller 14 starts rotating at such a timing that the front end of the recording paper and the front end of the toner image formed on intermediate transfer belt 7 will meet each other at the pressure nip between secondary transfer roller 11 and intermediate transfer belt 7.

Here, in full-color image forming mode in which all the image forming portions Pa to Pd are used to perform image forming, primary transfer rollers 6*a* to 6*d* are caused to bring intermediate transfer belt 7 into pressing contact with all the photoreceptor drums 3*a* to 3*d*. On the other hand, in monochrome image forming mode in which image forming portion Pa alone is used to perform image forming, primary transfer roller 6*a* alone is caused to press intermediate transfer belt 7 against photoreceptor drum 3*a*.

Next, the configuration of fixing unit 12 will be described in detail with reference to the drawings. FIG. 2 is an illustrative view showing the configuration of the fixing unit.

Fixing unit 12 includes, as shown in FIG. 2, a fixing part 12*a* and a pressing part 12*b*.

Fixing part 12*a* is comprised of endless fixing belt 121, fixing roller 122 and a heating member 123 as a heat generator (which will be referred to hereinbelow as "heater") having a curved surface, and a thermistor 124 for detecting the temperature of fixing belt 121.

Pressing part 12*b* includes a pressing roller 125.

A reference numeral P in the drawing indicates a recording medium and T an unfixed toner image.

Fixing belt 121 is wound over fixing roller 122 and heating member 123 so that the pressed fixing belt 121 rotates in the direction arrow R2 when pressing roller 125 is rotationally driven in the direction of arrow R1. Fixing roller 122 also rotates, following the rotation of fixing belt 121, in the same direction as that of fixing belt 121, or in the opposite direction of the rotation of pressing roller 125.

Fixing belt 121 is an endless belt of a hollow cylindrical form having a three-layered structure composed of a substrate, an elastic layer and a separation layer, laminated in the order mentioned from the interior side opposing heating member 123.

The substrate of fixing belt 121 is formed of a heat-resistant resin such as polyimide or the like, or a metal such as stainless steel, nickel or the like.

The elastic layer of fixing belt 121 is formed of a heat-resistant fluoro rubber or silicone rubber.

The separation layer of fixing belt 121 may use a fluoro synthetic resin.

As shown in FIG. 2, fixing roller 122 has a coaxial two-layered structure composed of a metal core 122*a* and an elastic layer 122*b* in the order mentioned from the interior (the central side). The both ends of the supporting shaft (not illustrated) of fixing roller 122 are rotatably supported by the unillustrated main frame by means of bearings (not illustrated).

Metal core 122*a* may use a metal such as iron, stainless steel, aluminum, copper or the like, or an alloy of these.

Silicone rubber, fluoro rubber or other rubbers having heat resistance are preferably used as elastic layer 122*b*.

In the present embodiment, fixing roller 122 with a diameter of 30 mm is used. As metal core 122*a*, a rod of stainless steel having a diameter of 20 mm is used. Elastic layer 122*b* is made of silicone sponge rubber of 5 mm thick.

Heating member 123 has a circular arc cross-section curved concentrically with fixing roller 122.

Heating member 123 is arranged closely to, and a predetermined gap apart from, the outer peripheral side of fixing roller 122 so as to cover its outer peripheral side.

Further, heating member 123 is formed with an opening 126 in the portion where fixing roller 122 and pressing part 12*b* oppose each other.

Opening 126 is formed along the direction in which the axis of fixing roller 122 extends (the axial direction). Opening 126 may and should be formed equal to or longer than the width of fixing belt 121 within the length of heating member 123 with respect to the axial direction.

Opening 126 has opening edges 123*e*1 and 123*e*2 extending in the axial direction.

These opening edges 123*e*1 and 123*e*2 are positioned closer to pressing part 12*b* (an aftermentioned fixing nip (nip area) 127) side than the central axis O of fixing roller 122 is located, with respect to the direction of a line connecting the axis of fixing roller 122 and the axis of pressing roller 125 in cross-section (the direction of the normal to the recording paper P to be conveyed).

Pressing roller 125 is put into press-contact with the peripheral surface of fixing roller 122 via fixing belt 121 so as to form fixing nip (nip area) 127 between fixing roller 122 and pressing roller 125 by virtue of elastic deformation of pressing roller 125.

Pressing roller 125 has an approximately cylindrical form having a three-layered structure composed of a metal core, an elastic layer and a separation layer, laminated in the order mentioned from the center of the approximate cylinder to the outer periphery.

The core of pressing roller 125 may use a metal such as iron, stainless steel, aluminum, copper or the like, or an alloy of these.

The elastic layer of pressing roller 125 is preferably formed of heat-resistant rubber material such as silicone rubber, fluoro rubber or the like.

The separation layer of pressing roller 125 is preferably formed of fluoro resins such as PFA (tetra fluoro ethylene-perfluoro alkylvinyl ether copolymer), PTFE (polytetrafluoroethylene) or the like.

The pressing roller used in the present embodiment has a diameter of 30 mm. The metal core is formed of an iron pipe (STKM) having a diameter of 26 mm with a wall thickness of 1 mm. The elastic layer of pressing roller 125 uses silicone solid rubber of 1 mm thick. The separation layer of pressing roller 125 uses a PFA tube of 50 μm thick.

Pressing roller 125 is arranged so as to oppose fixing roller 122 via fixing belt 121, and is rotationally driven by an unillustrated motor. The both ends of the supporting shaft (not illustrated) of pressing roller 125 are rotatably supported by an unillustrated supporting frame by means of bearings. One end of the supporting shaft is coupled with the motor shaft of the motor via gears (not illustrated). As the motor is controlled to turn by an unillustrated control, pressing roller 125 rotates.

A predetermined pressure (e.g., 400 $N/m^2$) is applied to the supporting frame so that pressing roller and fixing belt 131 form fixing nip 127. In the present embodiment, the fixing nip 127 is 7 mm wide.

As thermistor 124, a non-contact thermistor of an infrared detection type is used to detect the surface temperature of fixing belt 121. Based on the detection result from thermistor 124, current through the heater of heating member 123 is controlled so as to keep a predetermined fixing temperature.

The position of thermistor 124 is not limited to the upper side of fixing part 12*a* shown in FIG. 2. The thermistor may be disposed immediately before fixing nip 127 (on the upstream side with respect to the recording medium's direction of conveyance). Multiple thermistors may be laid out along the longitudinal direction of fixing roller 122 (across fixing belt 121) so as to perform temperature adjustment based on detection at the center and both ends of fixing belt 121. It is further possible to use a contact type thermistor as thermistor 124 though a non-contact thermistor of an infrared detection type is used in the present embodiment.

Example 1

Next, an example of fixing unit 12 of the present embodiment will be described with reference to the drawings.

Figure 3:
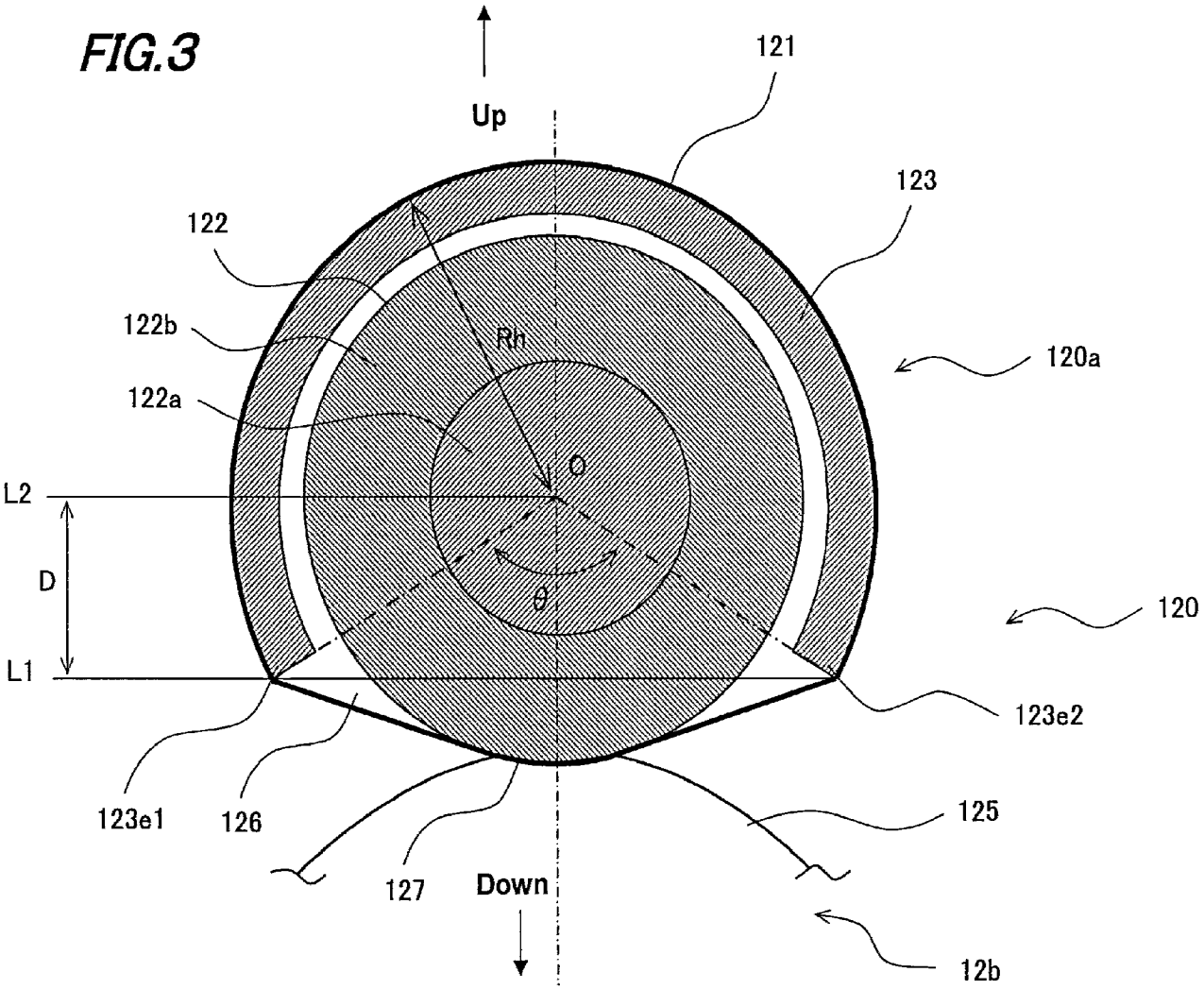
FIG. 3 is an illustrative view showing a configuration of example 1 of a fixing part that constitutes the fixing unit.
Figure 4A:
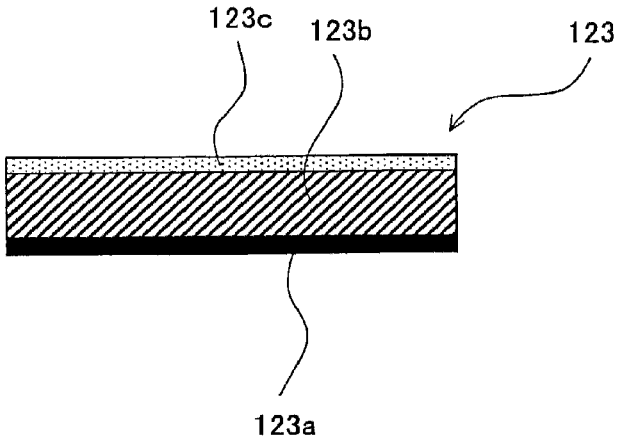
FIG. 4A is an illustrative view showing a layered structure of a heating member of the fixing part.
Figure 4B:
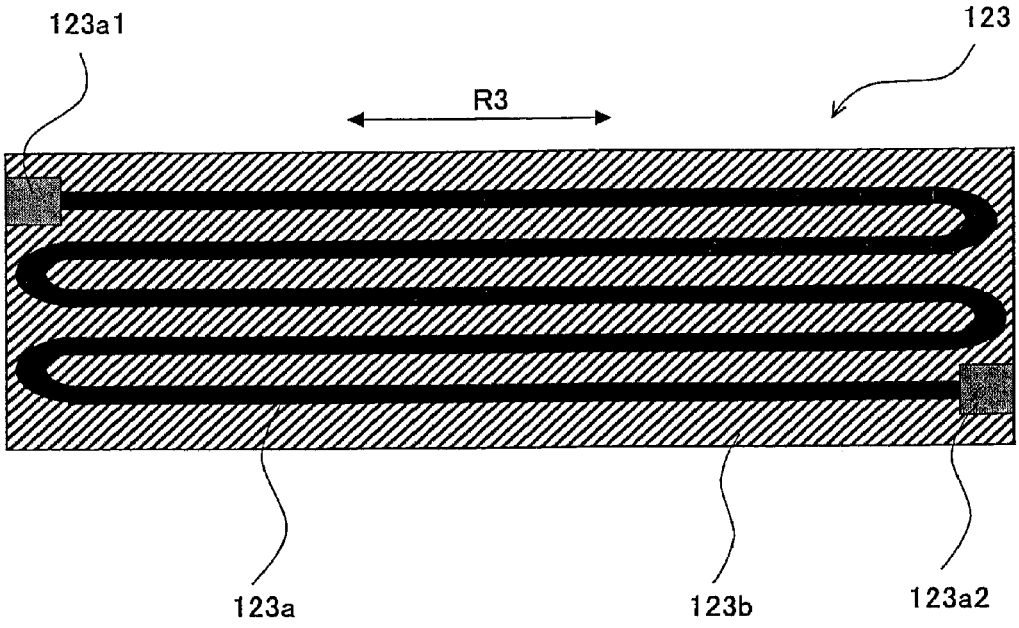
FIG. 4B is an illustrative plan view showing a pattern of the heating member.

FIG. 3 is an illustrative view showing a configuration of example 1 of a fixing part that constitutes the fixing unit of the present embodiment. FIG. 4A is an illustrative view showing a layered structure of a heating member of the fixing part that constitutes the fixing unit of the present embodiment. FIG. 4B is an illustrative plan view showing a pattern of the heating member.

A fixing unit 120 of example 1 has the same overall configuration as that of fixing unit 12 of the embodiment. In the description of fixing unit 120, the same components as those of the fixing unit of the embodiment are allotted with the same reference numerals without description.

In fixing unit 120 of example 1, a belt-like member, having a diameter of 36 mm, and formed of a base of polyimide of 50 μm thick, an elastic layer of silicone rubber of 150 μm thick and a separation layer of a PFA tube of 30 μm thick, is used as a fixing belt 121 of fixing part 120*a*.

Heating member 123 (heater: curved plate-shaped heat generator) has a cross section of a circular arc that is curved concentric with fixing roller 122.

Heating member 123 is arranged closely to, and so as to cover, the outer peripheral side of fixing roller 122.

Opening edges 123*e*1 and 123*e*2 extending in the longitudinal direction of heating member 123 (the axial direction of fixing roller 122) are positioned closer to pressing part 12*b* (fixing nip 127) side than the central axis O of fixing roller 122 is.

Heating member 123 is formed of a heat resistor 123*a*, a substrate 123*b* and a coating layer 123*c*, as shown in FIGS. 4A and 4B.

Substrate 123*b* has a function of stretching and tensioning fixing belt 121 and a function of conducting heat generated from heat resistor 123*a* to fixing belt 121.

As the material of substrate 123*b*, insulators such as ceramics, quartz glass and the like are mainly used. A substrate of quartz glass of 1 mm thick is used in example 1.

Here, it is also possible to use aluminum, iron, copper or the like as the material of substrate 123*b*. However, in the case where a conductive metal substrate is used, it is necessary to provide an insulating layer of polyimide or the like between the substrate and the heat resistor.

Since coating layer 123*c* conducts heat and guides fixing belt 121 in a sliding manner, it is necessary to use a material that reduces friction. As the material for coating layer 123*c*, fluoro resins such as PFA, PTFE and the like are preferably used. In example 1, PTFE of 20 μm thick is used as the coating layer.

Heat resistor 123*a* is made of a material made of silver-palladium, carbon or the like that generates heat by passing electric current. As shown in FIG. 4B, this heat resistor 123*a* is formed on substrate 123*b* by holding the resistor multiple times in a zigzag manner along the axial direction of fixing roller 122 (the direction of arrow R3). Provided at both ends of heat resistor 123*a* are electrodes 123*a*1 and 123*a*2.

Electrodes 123*a*1 and 123*a*2 are formed of silver paste, at least, one end of heating member 123 with respect to the longitudinal direction, and connected to an unillustrated a.c. power unit so that heat resistor 123*a* generates heat by voltage application of a.c. 100 V.

In example 1, heat resistor 123*a* is provided by forming a sintered film that is patterned with carbon paste as shown in FIG. 4B to be about 10 μm thick so that the rated output is set at 100V/1000 W.

This heating member 123 is arranged so as to cover, and a predetermined gap apart from, the outer peripheral side of fixing roller 122, as shown FIG. 3.

Further, heating member 123 is given in a cylindrical form having opening 126 as a part thereof.

The shape of heating member 123 sectioned by the plane perpendicular to the axis of fixing roller 122 is made concentrically with fixing roller 122.

The plane that includes both opening edges 123*e*1 and 123*e*2 extending along the longitudinal direction of heating member 123 (the axial direction of fixing roller 122) is located on the lower side (the pressing roller 125 (fixing nip 127) side) than the center axis O of fixing roller 122 is.

In example 1, when L1 designates a virtual line cutting through both opening edges 123*e*1 and 123*e*2 of heating member 123 and L2 designates a virtual line that is parallel to virtual line L1 and cuts through central axis O of fixing roller 122, the fixing unit is constructed so that virtual line L1 is positioned on the lower side (the fixing nip 127 side) of virtual line L2, as shown in FIG. 3.

With this arrangement, the contact area of fixing member 123 with fixing belt 121 can be made large so that it is possible to transfer heat from the backside of heating member 123 to fixing belt 121 and prevent diffusion of heat to the outside from fixing belt 121 and from the gap between fixing belt 121 and heating member 123 while keeping the cross section of heating member 123 and fixing roller 122 to a minimum. As a result, it is possible to provide a fixing unit 12 that is excellent in heat performance and energy efficiency without making the apparatus bulky.

Fixing unit 120 of example 1 is arranged so that the outside diameter Rh of heating member 123 is 36 mm, the distance D between virtual line L1 and virtual line L2 is 18 mm so that opening 126 forms an opening angle θ of about 120 degrees. Though, in this case, the distance D on the upstream side and that on the downstream side of fixing nip 127 are set equal to each other, it is not necessary to impose such restrictions but these distances can be specified appropriately depending on the apparatus configuration.

Example 2

Next, another configuration of a fixing unit 12 of the present embodiment will be described taking an example 2 with reference to the drawings.

Figure 5:
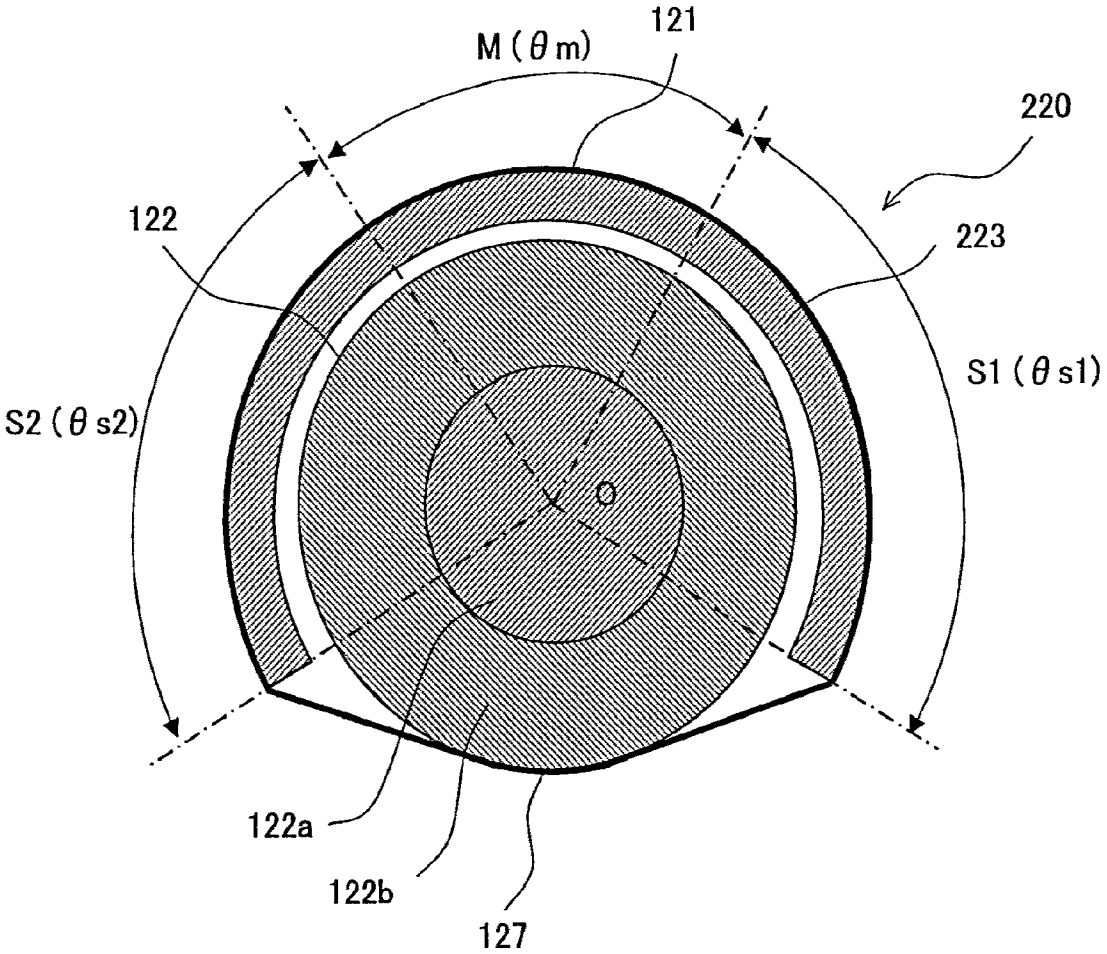
FIG. 5 is an illustrative view showing a configuration of example 2 of a fixing part that constitutes the fixing unit.
Figure 6:
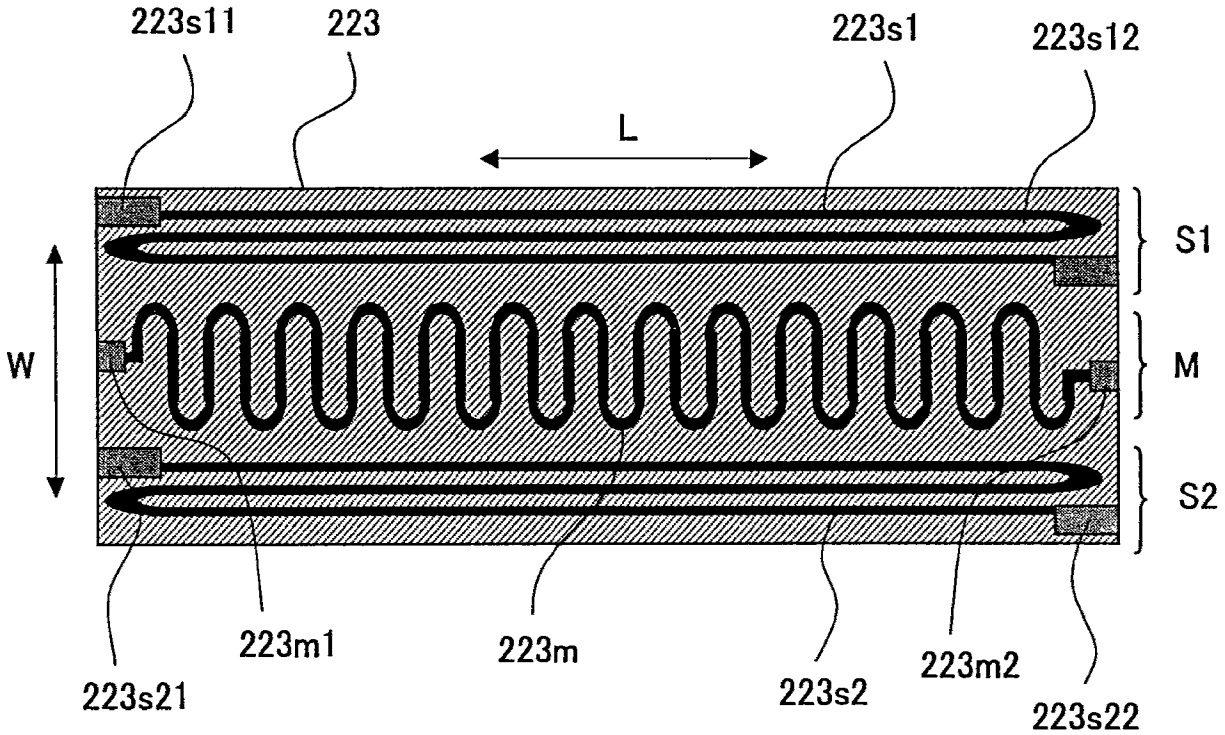
FIG. 6 is an illustrative plan view showing a pattern of a heating member of the fixing part; and, FIG. 7 is an illustrative view showing a configuration of example 3 of a fixing part that constitutes the fixing unit.

FIG. 5 is an illustrative view showing a configuration of example 2 of a fixing part that constitutes the fixing unit of the present embodiment. FIG. 6 is an illustrative plan view showing a pattern of a heating member of the fixing part.

A fixing unit 220 of example 2 has the same configuration as that of the fixing unit of example 1 except for the structure of heating member 223. So, in the description of fixing unit 220, the same components as those of the fixing unit of example 1 are allotted with the same reference numerals without description.

Fixing unit 220 of example 2 is adapted so that distribution of heat generation from a heating member 223 (heater: curved plate-shaped heat generator) is made uneven with respect to the circumferential direction of fixing roller 122, as shown in FIG. 5. Specifically, heating member 223 is configured so that the heating value per unit area becomes greater as the contact force between fixing belt 121 and the heater is greater. In particular, if the same power is input, it is possible to extract heat energy efficiently when the heating value at the area where fixing belt 121 is stretched with a greater force and hence fixing belt 121 and heating member 223 are put into close contact with each other is made higher.

As shown in FIG. 5, heating member 223 in example 2 is constructed of three parts, that is, two sub heating areas S1 and S2 located on both sides close to fixing nip 127 with respect to the circumferential direction of fixing roller 122 and a main heating area M located in the center between the two. The power supplied to main heating area M is specified to be greater than the power supplied to each of sub heating areas S1 and S2.

With this arrangement, the tensile force of fixing belt 121 acts more strongly on the area in heating member 223 corresponding to main heating area M, it is hence possible to conduct heat more efficiently.

In example 2, when θm represents the angle over which main heating area M of the belt extends, and θs1 and θs2 represent the angles over which sub heating areas S1 and S2 of the belt extend respectively, heating member 223 is configured such that θm=60°, θs1=θs2=88°, the power consumption of main heating area M is 500 W and the power consumption of each of sub heating areas S1 and S2 is 250 W.

As shown in FIG. 6, in heating member 223, a main heat resistor 223*m* is arranged in main heating area M located in the center part of heating member 223 while sub heat resistors 223*s*1 and 223*s*2 are arranged in sub heating areas S1 and S2 located on both sides of heating member 223.

Main heat resistor 223*m* is folded multiple times in a zigzag manner with respect to the width direction (the direction of arrow W: the circumferential direction) and formed over the longitudinal direction (the direction of arrow L).

Sub heat resistors 223*s*1 and 223*s*2 are each folded multiple times in a zigzag manner along the axial direction (the direction of arrow L) and formed over a predetermined width with respect to the width direction (the direction of arrow W: the circumferential direction).

That is, main heat resistor 223*m* and sub heat resistors 223*s*1 and 223*s*2 are made different in folding direction and formed across the longitudinal direction (the direction of arrow L) of heating member 223.

Here, the arrangement for making the heat generation distribution of the heater in heating member 223 uneven with respect to circumferential direction of fixing roller 122 is not limited to this. For example, main heat resistor 223*m* and sub heat resistors 223*s*1 and 223*s*2 may be folded zigzag in the same direction while the density of heat resistance lines per unit area may be made different therebetween.

Reference numerals 223*m*1 and 223*m*2 in the drawing designate the electrodes arranged on both ends of main heat resistor 223*m*, and reference numerals 223*s*11 and 223*s*12 designate the electrodes on both ends of sub heat resistor 223*s*1 and reference numerals 223*s*21 and 223*s*22 designate the electrodes on both ends of sub heat resistor 223*s*2.

With this arrangement of heating member 223 of example 2, the tension of fixing belt 121 acts more strongly on the area corresponding to main heating area M, it is hence possible to conduct heat more efficiently. Here, the power consumption and patterns of individual heat resistors are not limited to the above example, but can be changed depending on the condition of installation. The material for heating member 223 is not limited to the above.

Example 3

Next, another configuration of a fixing unit 12 of the present embodiment will be described taking an example 3 with reference to the drawings.

Figure 7:
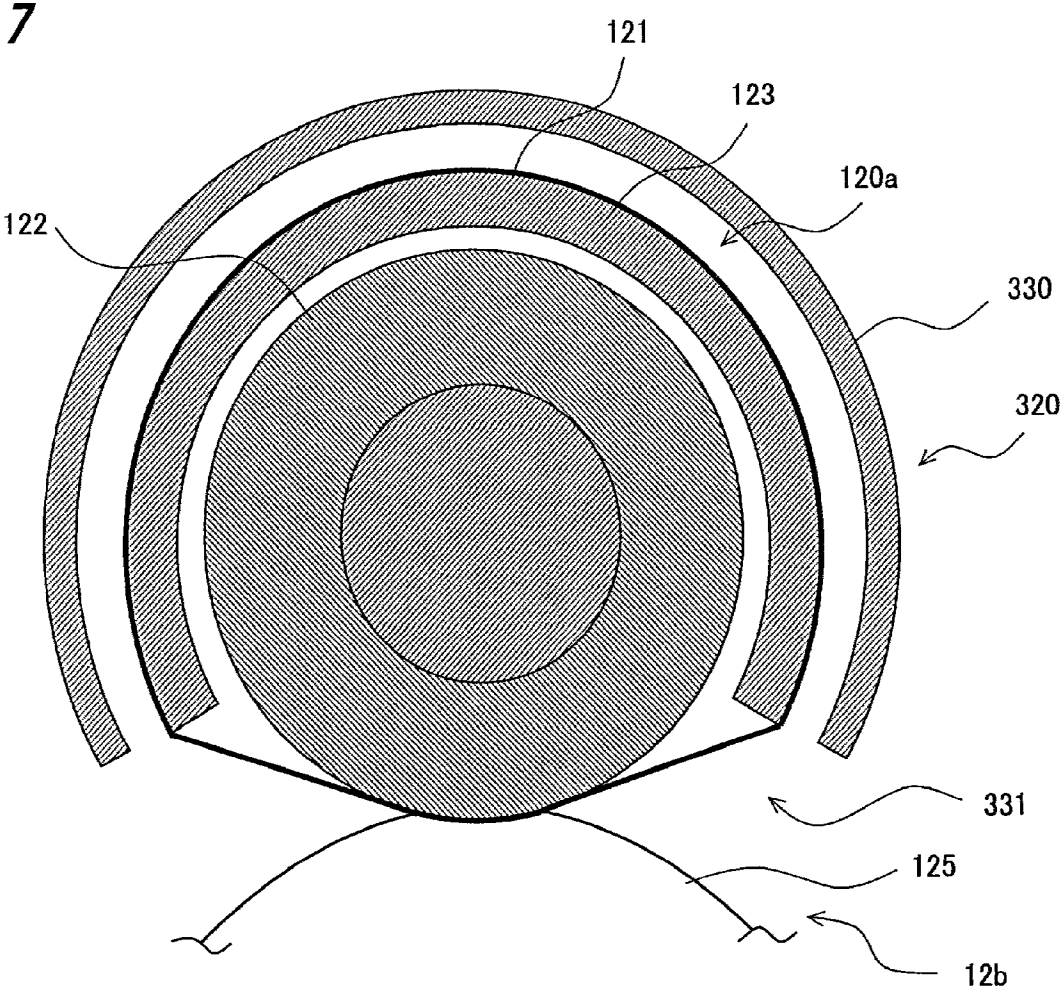

FIG. 7 is an illustrative view showing a configuration of example 3 of a fixing part that constitutes the fixing unit of the present embodiment.

A fixing unit 320 of example 3 has the same configuration as that of the fixing unit of example 1 except for the configuration of an insulating member 330. So, in the description of fixing unit 320, the same components as those of the fixing unit of example 1 are allotted with the same reference numerals without description.

In fixing unit 320 of example 3, insulating member 330 that covers the outer peripheral side of heating member 123 via fixing belt 121 is arranged close to the outer peripheral side of fixing belt 121 in a range where fixing belt 121 comes into contact with heating member 123, as shown in FIG. 7.

Insulating member 330 has a circular arc cross-section curved concentrically with fixing roller 122.

Insulating member 330 is formed along the outer peripheral side of heating member 123 and arranged closely to fixing belt 121 so as to cover its outer peripheral side.

Further, insulating member 330 has an opening 331 extended in the axial direction of fixing roller 122, so as to open the portion where fixing roller 122 and pressing part 12*b* oppose each other.

Arrangement of insulating member 330 so as to cover fixing part 12*a* in the above way makes it possible to prevent diffusion of heat from the fixing belt 121 surface.

The concentric configuration of insulating member 330 with fixing roller 122 and heating member 123 makes it possible to provide a fixing unit that has the minimum cross section and is excellent in space saving performance and energy efficiency without making the apparatus bulky.

As described heretofore, according to example 1 of the present exemplary embodiment, as the configuration of fixing unit 12 of image forming apparatus 100, heating member 123 is arranged closely to the outer peripheral side of fixing roller 122 so as to cover its outer peripheral side and is provided with opening 126 opposing the pressing part 12*b* side. Further, opening edges 123*e*1 and 123*e*2 of heating member 123 are positioned closer to pressing part 12*b* (fixing nip 127) side than the central axis O of fixing roller 122 is. Accordingly, it is possible for fixing belt 121 to take a large enough area to receive heat from heating member 123 and at the same time cover heating member 123 in its portion located closer to pressing part 12*b* side than the central axis O of fixing roller 122 is. Thus, this configuration not only makes it possible to prevent heat leakage but also enables use of heat from the backside of heating member 123.

As a result, it is possible to reduce loss of heat energy in fixing unit 12 and perform stable fixing of toner images to recording mediums.

Further, as in example 2, arrangement of heat member 223 so as to vary its heat generation distribution along the circumferential direction of fixing roller 122, makes it possible to conduct heat more efficiently.

Finally, as in example 3, provision of insulating member 330 that covers fixing part 12*a* makes it possible to inhibit radiation of heat from the surface of the fixing belt.

Though the above embodiment was described taking examples in which the image forming apparatus of the present invention is applied to image forming apparatus 100 shown in FIG. 1, as long as it is an image forming apparatus that includes a fixing device, the invention can be developed to any other image forming apparatus and the like, not limited to the image forming apparatus and copier having the configuration described above.

Having described heretofore, the present invention is not limited to the above embodiment, various changes can be made within the scope of the appended claims. That is, any embodied mode obtained by combination of technical means modified as appropriate without departing from the spirit and scope of the present invention should be included in the technical art of the present invention.

What is claimed is:

1. A fixing device comprising a fixing part and a pressing part, the fixing part including:

a fixing roller;

a heating member as a heat generator having a curved surface; and, an endless fixing belt wound between the fixing roller and the outer peripheral side of the heating member, the pressing part being arranged so as to oppose the fixing roller and press the fixing roller via the fixing belt, wherein the heating member is arranged close to, and so as to cover, the outer peripheral side of the fixing roller, and formed with an opening extending along an axial direction of the fixing roller so as to open, at least, the portion where the fixing roller and the pressing part oppose each other, and edges defining the opening, extending along the axial direction of the fixing roller, are positioned closer to the pressing part side than the center axis of the fixing roller is.

2. The fixing device according to claim 1, wherein the heating member has a circular arc cross-section curved concentrically with the fixing roller.

3. The fixing device according to claim 1, wherein the heating member generates uneven distribution of heat with respect to a circumferential direction of the fixing roller.

4. The fixing device according to claim 1, wherein the distribution of heat generated by the heating member is specified such that a heating value per unit area is higher at a place as the contact force with the fixing belt is stronger at the place.

5. The fixing device according to claim 1, wherein an insulating member that covers the heating member in whole or in part via the fixing belt is arranged close to the outer peripheral part of the fixing belt that is put in contact with the heating member.

6. The fixing device according to claim 5, wherein the insulating member has a circular arc cross-section curved concentrically with the fixing roller.

7. An image forming apparatus including a fixing device for fixing a toner image formed on a recording medium to the recording medium, wherein the fixing device employs the fixing device defined in claim 1.

* * * * *